US005414340A

United States Patent [19]

Gannon

[11] Patent Number: 5,414,340

[45] Date of Patent: May 9, 1995

[54] FEEDBACK CIRCUIT FOR HIGH EFFICIENCY LINEAR DC POWER SUPPLY

[76] Inventor: Henry M. Gannon, 2026 10th St., Boulder, Colo. 80302

[21] Appl. No.: 199,109

[22] Filed: Feb. 22, 1994

[51] Int. Cl.[6] ..... G05F 1/44

[52] U.S. Cl. ..... 323/266

[58] Field of Search ..... 323/266, 269, 273, 274, 323/282, 284, 902

[56] References Cited

U.S. PATENT DOCUMENTS 4,881,023 11/1989 Parusse et al. ..... 323/266
5,124,630 6/1992 Tsutsumi ..... 323/902 X
5,237,263 8/1993 Gannono ..... 323/288

*Primary Examiner*—Steven L. Stephan

*Assistant Examiner*—E. To

[57] ABSTRACT

A high efficiency, linear DC power supply circuit includes a pulse width modulator stage for reducing a higher DC source voltage to a lower DC operating voltage at high efficiency, an energy storage device, a linear voltage regulator, and a feedback circuit. The feedback circuit monitors the voltage across the linear voltage regulator and sends a frequent or continuous feedback signal to the pulse width modulator to maintain a relatively fixed voltage across the linear regulator regardless of nominal variations in source voltage, operating temperature, load current, noise, or other shifting parameters. By monitoring only the voltage across the linear regulator, a significant enhancement in performance of the power supply circuit is realized.

4 Claims, 2 Drawing Sheets

FEEDBACK CIRCUIT FOR HIGH EFFICIENCY LINEAR DC POWER SUPPLY

BACKGROUND OF THE INVENTION

The present invention relates to a high efficiency, linear DC power supply. More particularly, the present invention relates to an innovative linear DC power supply which takes a higher DC (or rectified ac) voltage from a source, reduces it to a lower DC voltage with low regulation and electrical noise for a load, includes a pulse-width-modulation (PWM) stage and a linear voltage regulation stage arranged in series, with the PWM stage and tile linear voltage regulation stage coupled with an energy storage means, and coordinated by a feedback circuit.

The present invention draws power from essentially any DC or rectified AC source, outputs DC power to essentially any type of load (though is optimized for electronic loads), offers high efficiency as compared with past art, attenuates the electrical noise inherent in a DC or rectified AC source equal to or better than past art, adds little or no electrical noise of its own, and can be built with fewer and less expensive parts. Because of this combination of traits, the present invention is useful in a wider range of applications and at lower cost, and thereby represents a new and useful invention.

The use of DC electronic appliances such as telephone answering machines and portable computers in mobile applications (recreational vehicles, autos, boats, etc) and in solar electric applications has risen dramatically in recent years. Although such appliances might be powered by dedicated batteries, power derived from a mobile or solar electric battery bank is often more convenient and economical to use.

A power supply is usually required for satisfactory and reliable operation of such electronic appliances in such environments. Battery bank voltage must usually be reduced to a lower level, delivered voltage held steady (regulated) regardless of variations in bank voltage or current draw by the appliance, and transient voltages which might be generated by a variety of sources and broadly referred to as "noise" attenuated.

For example, charging typically raises battery bank voltage by about a volt, heavy loads which share the bank can pull down voltage by an equal amount, and ignition coils and motors routinely generate potentially interfering and damaging transient voltages. Moreover, using a higher voltage boost to start a engine or connecting jumper cables improperly may cause immediate damage. Meanwhile, current draw by a typical electronic load such as a telephone answering machine may vary from 100 milliamperes when idle, to 1.2 amperes as the tape drive motor first activates.

Prior art for DC power supplies falls into several basic categories. Dropping resistors are perhaps the simplest and least expensive solution. For example, placing a, 12 ohm dropping resistor between a 24 volt battery bank and a 12 volt appliance drawing one ampere of current results in correct voltage delivery. However, as much power is dissipated in this dropping resistor as in the load, bank variations and noise are attenuated by only half, and delivered voltage changes as the appliance draws more or less current. A voltage divider, wherein the dropping resistor is referenced to both the positive and negative terminals of the bank and the load connected intermediate, somewhat stabilizes delivered voltage. However, improvement is at further expense to efficiency.

Although tapping individual cells of a battery bank to reduce voltage leads to imbalance, a Vanner power supply effectively splits a bank employing two identical batteries connected in series in half. Power is drawn first from one battery, and then from the other. While efficiency is high and delivered voltage as the appliance draws more or less current steady, only a single voltage can be obtained (half the series voltage), and bank voltage variations and noise are attenuated by no more than half.

Another solution is using a DC inverter to convert battery bank voltage to AC, and then using an AC-to-DC adaptor to convert the result back to DC at the correct voltage. Though credible, this solution is probably too expensive and bulky for most applications.

Buck regulators, which are becoming popular in prior art, provide DC voltage reduction at efficiencies in the low to mid 80 percent range, good regulation, and good attenuation of noise from external sources. Typically, a Buck regulator outputs high frequency PWM pulses (in the 50 kHz range) into what is essentially a dampened LC filter. Because the effectiveness of reactive elements increases directly with frequency, only relatively small values of L and C are needed. A DC output for the load is taken directly from this filter. Regulation is accomplished as the instantaneous voltage developed across this filter is fed back to the regulator, compared with a reference voltage, and PWM adjusted accordingly.

One disadvantage of Buck regulators is that because PWM is at radio frequency, switching losses within the regulator are invariably substantial. Another disadvantage is that the LC filter never completely smooths the PWM pulses, particularly as the load draws more current. For this reason, a Buck regulator is not useful with an electronic appliance having components operating near the PWM oscillation frequency (such as an am radio) or some harmonic multiple. A further disadvantage is that means for interference rejection such as shielding, use of short leads, and positioning of components may be necessary to minimize unwanted electric, magnetic, and electromagnetic coupling.

A linear voltage regulator is perhaps the best solution if relatively little load current is required. For example, a widely available and inexpensive three terminal linear voltage regulator reduces supply voltage to a preset or adjustable lower level, regulates for both bank and load variations thereby holding delivered voltage steady, and attenuates noise. Viewed with an oscilloscope, a straight line (linear voltage) is seen across the load.

However, like dropping resistors, linear voltage regulators dissipate energy in proportion to voltage dropped. For example, a 4 watt (internal dissipation) linear voltage regulator drawing power from a 24 volt battery bank and supplying power to a 6 volt load has an efficiency of less than 25 percent, and can continuously output no more than about 0.22 amperes of current. Although units capable of supplying more current and dissipating more heat are available, use is infrequent because of higher cost, the need for expensive heat sinking and perhaps a cooling fan, and battery bank drain.

A linear voltage regulator needs to receive an operating voltage which is high enough to power the load, provide for internal operation, and stay below the noise level which may be present in the supply. Voltage in excess of this amount serves no useful purpose, and is simply dissipated as heat. For example, the optimal operating voltage for a particular regulator powering a 6 volt load might be 7.5 volts, of which 6 volts goes to the load, 0.5 volts to internal operation, and 1 volt to staying below noise levels.

SUMMARY OF THE INVENTION

Accordingly, it is the primary object of the present invention to provide a DC power supply useful in a wider range of applications and at a lower cost than is available with prior art power supplies.

An additional objective of the present invention is to employ a PWM stage to maximize efficiency. A relatively low PWM oscillating frequency is also employed to increase efficiency and minimize the potential for interference. Coils and transformers, which produce particularly troublesome magnetic fields and require a relatively high oscillating frequency for best performance, are avoided.

A further objection of the present invention is to use only widely available and relatively inexpensive parts, such as might be purchased directly through a distributor.

Another further objective is high attenuation of externally generated noise, and a minimum amount of internally generated noise.

A still further objective is high DC-conversion efficiency in order to minimize the need for heat sinking, to make maximum use of space, and to minimize battery drain. Low standby power drain is a related objective.

A final objective is linear quality DC voltage output for best performance and stability of driven circuitry. Characteristics include excellent regulation and high noise attenuation.

DETAILED DESCRIPTION OF THE PREFERRED EMBODIMENT

Figure 1:
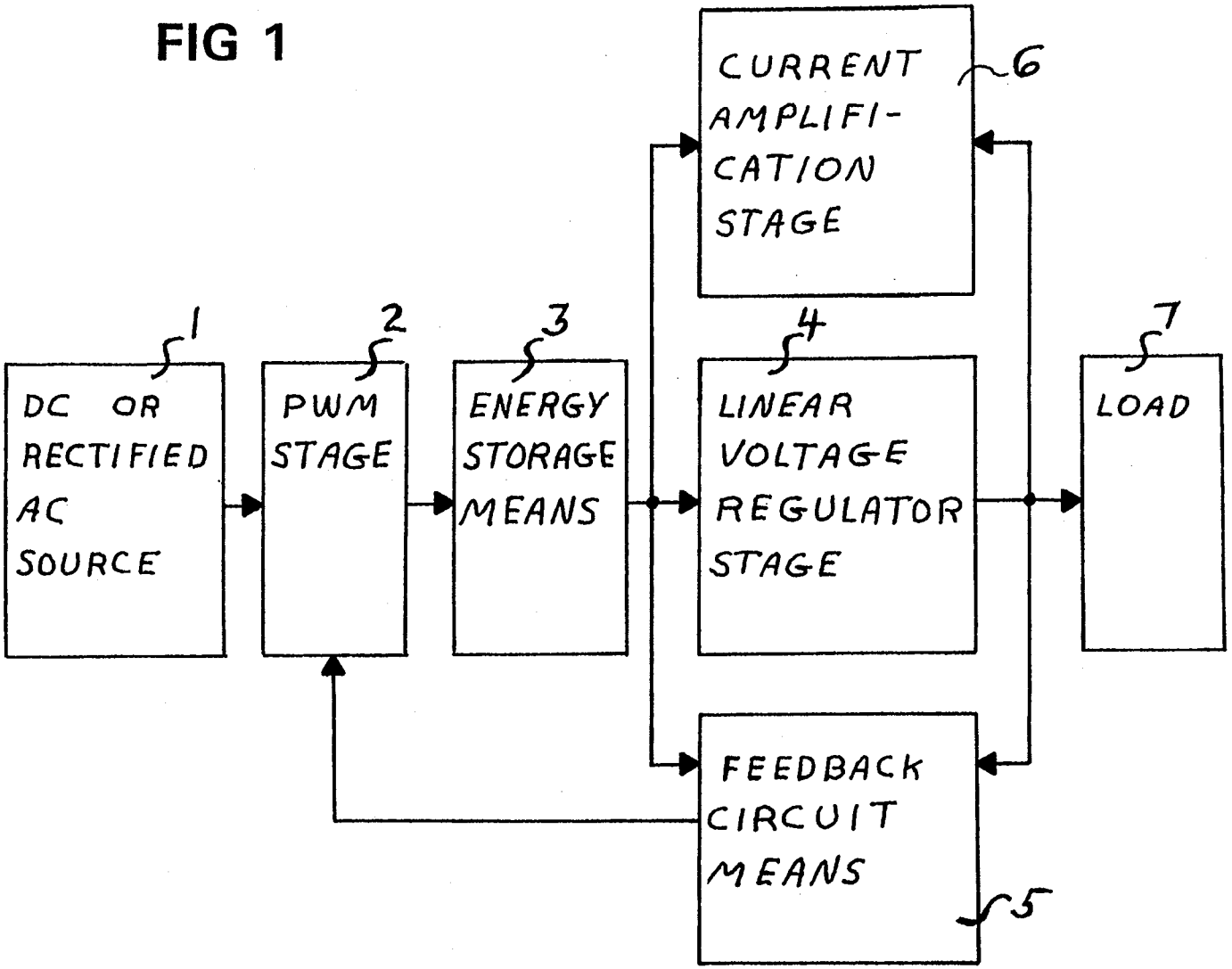
FIG. 1 is a block diagram of a power supply constructed in accordance with the present invention.
Figure 2:
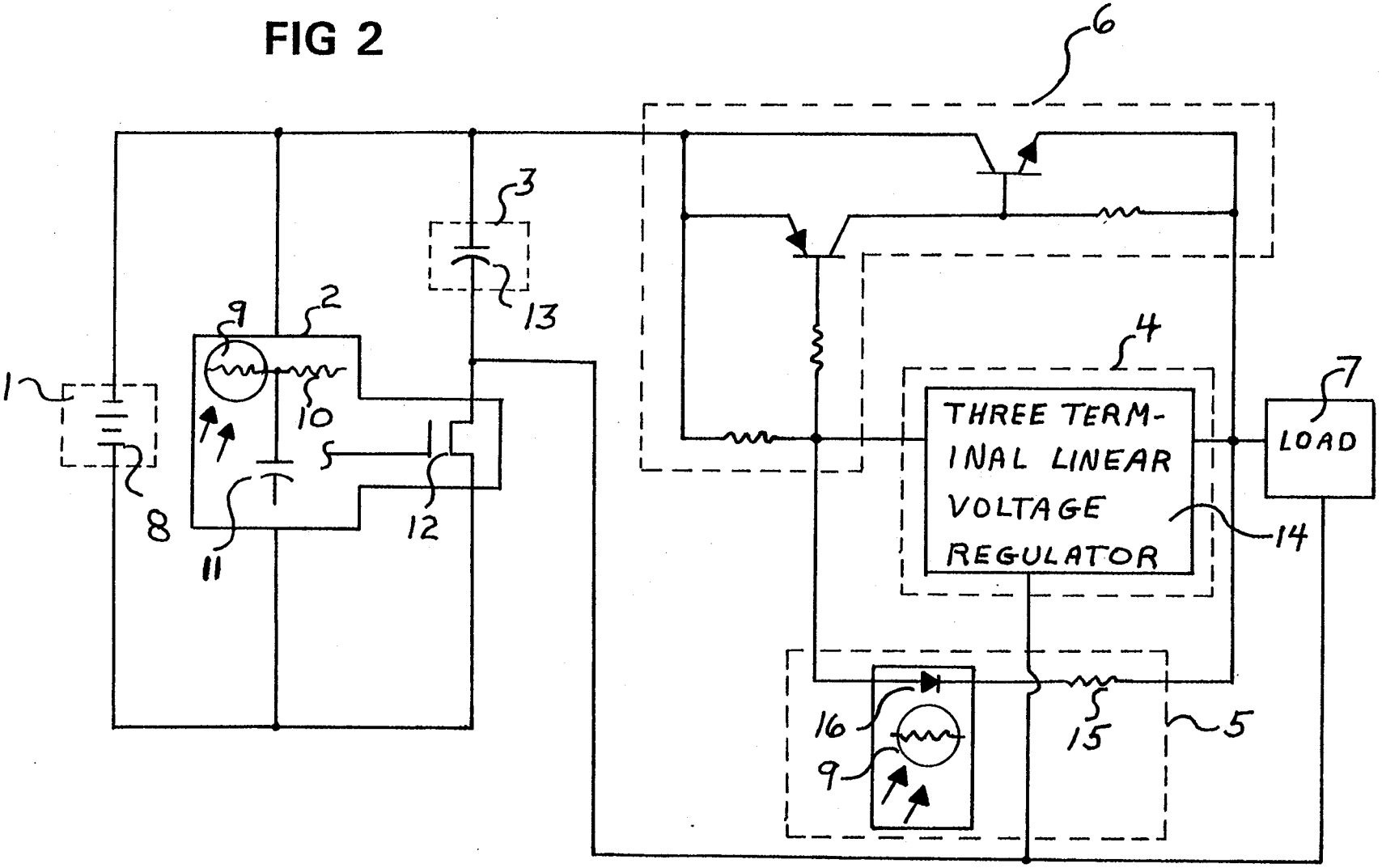
FIG. 2 is a detailed schematic diagram of the power supply of FIG. 1.

Referring to FIG. 1 and FIG. 2, a DC or rectified AC power source 1, which may comprise battery bank 8, delivers power at a relatively high voltage to a PWM stage 2, here implemented by a PWM device detailed in U.S. Pat. No. 5,237,263.

With this PWM device, the charging of capacitor 11 through the value of photoresistor 9 sets the ON time of each generated power pulse, and the discharging of capacitor 11 through the value of fixed resistor 10 sets the OFF time of each generated power pulse.

MOSFET 12, which forms a part of PWM stage 2, delivers power pulses to energy storage means 3, which may be comprised of capacitor 13. Energy transfer efficiency is high, as the ON resistance of MOSFET 12 is about 0.028 ohms, and the OFF resistance is about 10 million ohms. Oscillating frequency of the stage is set for about 250 Hz to minimize switching losses.

Power stored in capacitor 13 is delivered to linear voltage regulator stage 4, here performed by three terminal linear voltage regulator 14. Linear voltage regulator stage 4 could be any of the fixed or adjustable linear regulators known in the art. Current amplification stage 6 could be any of the current amplifiers known in the art.

Feedback circuit 5 is here comprised of current limiting resistor 15 and LED 16. Photoresistor 9, which is also shown, is electrically a part of PWM stage 2 though positioned in close proximity to LED 16 for the purpose of receiving an optical signal. The resistance of photoresistor 9 varies from about 50 ohms in bright light, to about 1 million ohms in total darkness. Instantaneous value sets the ON time of each generated power pulse.

Load 7 is essentially any load, though in most cases would represent an electronic load containing sensitive electronic components.

Feedback circuit 5 is central to operation, and functions to maintain an optimal operating voltage to the linear voltage regulator regardless of a number of changing parameters. It does so by simply maintaining a fixed voltage across the regulator which is just high enough to provide for internal operation and stay below the noise level of the supply. About 1.5 volts is needed for the preferred embodiment using three terminal linear voltage regulator 14.

If voltage across three terminal linear voltage regulator 14 falls below 1.5 volts, voltage to LED 16 is correspondingly low as is illumination to photoresistor 9. The resulting higher resistance coupled to photoresistor 9 causes proportionally longer and more powerfill PWM pulses delivered to capacitor 13 to correct the imbalance.

On the other hand if voltage across three terminal linear voltage regulator 14 rises above 1.5 volts, voltage to LED 16 is correspondingly high as is illumination to photoresistor 9. The resulting relatively lower resistance coupled to photoresistor 9 causes proportionally shorter and less powerful PWM pulses delivered to capacitor 13 to correct the imbalance.

Feedback circuit 5 is fast acting as compared with the PWM oscillation frequency, and response even needs to be dampened somewhat to prevent oversupervision. Feedback circuit 5 can adjust the PWM level from essentially zero to better than a 50%.

When placed between a 24 volt battery bank and a 6 volt load, efficiency of this DC power supply is a nominal 75% (versus about 25% or a three terminal voltage regulator used alone); 86% with a 12 volt load, and 88% with a 15 volt load. High efficiency plus a linear quality DC output are thus realized in a single power supply.

I claim:

1. A high efficiency linear DC power supply comprising:

a source of DC input voltage;

a pulse width modulator coupled to said source of DC input voltage for transforming said DC input voltage to a lower DC operating voltage;

energy storage means coupled to said pulse width modulator for filtering and storing said DC operating voltage;

a linear voltage regulator coupled to said energy storage means for receiving said DC operating voltage and for providing a regulated DC output voltage to a load; and feedback circuit means shunted directly across said linear voltage regulator and having an output coupled to said pulse width modulator, said feedback circuit means being operative for controlling said pulse width modulator to maintain a desired fixed voltage across said linear voltage regulator.

2. A high efficiency linear DC power supply as in claim 1 wherein:

said feedback circuit means includes a light emitting diode for sensing said voltage across said linear voltage regulator and for producing an optical signal whose intensity increases in proportion to an increase in said voltage across said linear voltage regulator above a threshold value; and said pulse width modulator includes a photoresistor positioned proximal to said light emitting diode of said feedback circuit means for receiving said optical signal and for controlling said DC operating voltage in response thereto.

3. A high efficiency linear DC power supply as in claim 1 further comprising a current amplifier coupled across said linear voltage regulator for increasing a load current which said linear DC power supply is capable of supplying to said load.

4. A high efficiency linear DC power supply as in claim 2 further comprising a current amplifier coupled across said linear voltage regulator for increasing a load current which said linear DC power supply is capable of supplying to said load.

* * * * *